US006142054A

United States Patent [19]

Ettmüller

[11] Patent Number: 6,142,054

[45] Date of Patent: Nov. 7, 2000

[54] APPARATUS FOR FILLING SHELL BODIES WITH SUB-PROJECTILES

[75] Inventor: Peter Ettmüller, Adlikon, Switzerland

[73] Assignee: Oerlikon Contraves Pyrotec AG, Zurich, Switzerland

[21] Appl. No.: 09/506,334

[22] Filed: Feb. 18, 2000

Related U.S. Application Data

[62] Division of application No. 08/627,586, Apr. 4, 1996, Pat. No. 6,049,957.

[30] Foreign Application Priority Data

Apr. 5, 1995 [CH] Switzerland ..... 978/95

[51] Int. Cl.[7] ..... F42B 33/02

[52] U.S. Cl. ..... 86/33; 86/26; 86/27

[58] Field of Search ..... 86/29, 31, 33, 86/24, 26, 25, 27

[56] References Cited

U.S. PATENT DOCUMENTS

| | | | |
|---|---|---|---|
| 2,682,983 | 7/1954 | Ashcroft . | |
| 3,014,400 | 12/1961 | Smith | 86/33 |
| 3,027,694 | 4/1962 | Adler . | |
| 3,093,072 | 6/1963 | Pigman . | |
| 3,451,186 | 6/1969 | Shutt . | |
| 3,517,478 | 6/1970 | Winch . | |
| 4,022,353 | 5/1977 | Hamlin | 222/276 |
| 4,517,791 | 5/1985 | Pocke . | |
| 4,586,314 | 5/1986 | Monge . | |
| 4,713,926 | 12/1987 | Mennie et al. . | |
| 4,777,882 | 10/1988 | Schumachor et al. . | |
| 5,310,300 | 5/1994 | Crabb et al. . | |
| 5,396,697 | 3/1995 | Peltier et al. . | |

FOREIGN PATENT DOCUMENTS

| | | |
|---|---|---|
| 180002 | 6/1988 | European Pat. Off. . |
| 1307717 | 9/1962 | France . |
| 2606135 | 6/1988 | France . |

OTHER PUBLICATIONS

OC 2052 d94, Oerlikon–Contraves, "AHEAD –Skyguard Fire Control/35 mm Twin Gun Defence System Demonstration", Sep. 21–22, 1993.

*Primary Examiner*—Charles T. Jordan
*Assistant Examiner*—Lulit Semunegus
*Attorney, Agent, or Firm*—Greenblum & Bernstein, P.L.C.

[57] ABSTRACT

Device for filling a shell body with a plurality of sub-projectiles including a U-shaped assembly centering device coupled with a cover. A reservoir, formed between the assembly centering device and the cover, includes a slit-like shaped rectangle in cross-section. A flange is fastened in a lower area of the reservoir on the assembly centering device, and a slider for moving with respect to the reservoir includes a width corresponding to a length of the slit-like rectangle. A top portion includes a V-shaped notch extending along a longitudinal direction, and a bottom portion includes a V-shape extending along the longitudinal direction. A perforation, extending coaxially with the slider and provided in the assembly centering device, includes a first part approximately corresponding to an outline of the slider and a second part approximately corresponding to an outer periphery of a layer. A shoulder at an outlet of the perforation is provided for guiding the plurality of sub-projectiles into the shell body element, and a holding ring is fastened on the assembly centering device extending coaxially with the shoulder.

12 Claims, 8 Drawing Sheets

APPARATUS FOR FILLING SHELL BODIES WITH SUB-PROJECTILES

CROSS-REFERENCE OF RELATED APPLICATIONS

This application is a divisional of U.S. patent application Ser. No. 08/627,586, filed Apr. 4, 1996 now U.S. Pat. No. 6,049,957, and claims the priority of Swiss Application No. 00 978/95-5, filed on Apr. 5, 1995, the disclosures of which are expressly incorporated by reference herein in their entireties.

BACKGROUND OF THE INVENTION

1. Field of the Invention

The present invention relates to a method and apparatus for filling shell bodies with sub-projectiles. The shell body is filled in a defined geometric arrangement that eliminates sifting errors.

2. Discussion of the Background of the Invention and Material Information

Oerlikon-Contraves of Zürich, Switzerland discloses, in publication OC 2052 d 94, that an attacking target may be destroyed by sustaining multiple hits by shells containing sub-projectiles if, following ejection of the sub-projectiles, an expected area of the target is covered by a cloud formed by the sub-projectiles. The sub-projectiles are ejected by an explosive charge placed in the shell, such that when triggered, the part of the shell containing the sub-projectiles is separated and torn open at predetermined breaking points. In such a shell, it is important that the sub-projectiles are maintained securely and fixed against relative rotation in the shell. Rotation is transferred to the sub-projectiles, so that the shells travel over a stable trajectory. It is also disclosed that the sub-projectiles achieve spin-stabilization after ejection.

To improve the probability of a hit, the sub-projectiles should be distributed as evenly as possible lying on circular surfaces. The even distribution of sub-projectiles is primarily determined by a geometric arrangement of the sub-projectiles in the interior of the shell.

Each shell described above contains a relatively large amount of sub-projectiles which must be carefully fitted into the required geometric arrangement for the purpose of achieving identical properties. However, conventional filling methods can only achieve this goal after a large expenditure of time.

SUMMARY OF THE INVENTION

It is the object of the present invention to propose a method and apparatus for filling shell bodies with sub-projectiles which do not suffer from the above mentioned disadvantages.

According to the present invention, before being loaded, individual sub-projectiles may be combined into layers which are as thick as the length of the sub-projectiles and which extend in planes transversely to the longitudinal axis of the shell body. The individual sub-projectiles may assume a position in the layer which corresponds to a geometric arrangement in a hollow chamber of the shell body. During combination, the outer periphery of the layer may be configured so that, after insertion of the layer into the hollow chamber, the sub-projectiles may be secured against relative rotation and to maintain the geometric arrangement.

In accordance with a preferred embodiment, the outer periphery of the layer may have a hexagonal shape, and the axes of the individual cylindrical sub-projectiles may be aligned to be parallel with the longitudinal axis of the shell body.

In accordance with a further feature of the invention, several layers may be simultaneously created and, lying behind each other, may be simultaneously inserted into the hollow chamber of the shell body.

Another aspect of the present invention includes using several reservoirs for simultaneously creating several layers of sub-projectiles and for reducing filling time. The special design of the device in accordance with the present invention provides for combining sub-projectiles in hexagonal shaped layers and for placing them into the shell as hexagonal shaped layers.

According to one aspect of the present invention, the present invention is directed to a method for filling a shell body with a plurality sub-projectiles. The method includes combining the plurality of sub-projectiles into a plurality of layers, each of the plurality of layers including a thickness corresponding to a length of the plurality of sub-projectiles. The combining step includes positioning the plurality of sub-projectiles in each of the plurality of layers within a plane formed transversely to a longitudinal axis of the shell body, and forming a partial outer periphery of the plurality of sub-projectiles for a predetermined geometric arrangement. The method also includes inserting each of the plurality of layers into the shell body in a direction parallel to the longitudinal axis of the shell body. When inserted into the shell body, each of the plurality of layers retains its predetermined geometric arrangement.

In accordance with another feature of the present invention, the combining step further includes feeding each of the plurality of sub-projectiles into a reservoir through a top portion. Each of the plurality of sub-projectiles fall downward to rest on a first stop partially defining the outer periphery of each of the plurality of layers. The combining step further includes moving the plurality of sub-projectiles resting on the first stop a predefined amount onto a second stop positioned below the first stop with respect to the top portion, and maintaining the partially shaped outer periphery of the layer. The inserting step includes pushing from the reservoir each of the plurality of layers formed by the plurality of sub-projectiles located between the first stop and the second stop, the further pushing finally shaping the outer periphery of the layer into the predetermined geometric arrangement. Concurrently with the pushing, the first stop defines a partial outer periphery of a subsequent layer within the reservoir. A first layer and a predetermined number of subsequent layers that are pushed from the reservoir are inserted into the shell body to fill the shell body.

In accordance with another feature of the present invention, each of the plurality of sub-projectiles includes cylindrical bodies with a longitudinal axis, and each of the plurality of layers includes a plurality of the cylindrical bodies arranged such that the longitudinal axes of the cylindrical bodies extend parallel to the longitudinal axis of the shell body element. The outer periphery of each of the plurality of layers includes a hexagon shape.

In accordance with the present invention, each of the plurality of sub-projectiles includes cylindrical bodies with a longitudinal axis, and each of the plurality of layers includes a plurality of the cylindrical bodies arranged such that the longitudinal axes of the cylindrical bodies extend parallel to the longitudinal axis of the shell body element. The outer periphery of each of the plurality of layers includes an asymmetrical hexagon shape.

In accordance with a further feature of the present invention, the predefined amount corresponds to a diameter of a circle circumscribing the hexagon shape.

In accordance with a further feature of the present invention, the predefined amount corresponds to a diameter of a circle circumscribing the asymmetrical hexagon shape.

In accordance with yet another feature of the present invention, the method further includes simultaneously forming and pushing a plurality of layers, each of the plurality of layers successively positioned, and inserting the plurality of layers into the hollow chamber of the shell body element.

According to another aspect of the present invention, the present invention is directed to an apparatus for filling a shell body with a plurality of sub-projectiles. The apparatus includes a U-shaped assembly centering device coupled with a cover, a reservoir, formed between the assembly centering device and the cover, including a slit-like shaped rectangle in cross-section, a flange fastened in a lower area of the reservoir on the assembly centering device, and a slider for moving with respect to the reservoir. The slider includes a width corresponding to a length of the slit-like rectangle, a top portion including a V-shaped notch extending along a longitudinal direction, and a bottom portion including a V-shape extending along the longitudinal direction. The apparatus further includes a perforation, extending coaxially with the slider and provided in the assembly centering device, including a first part approximately corresponding to an outline of the slider and a second part approximately corresponding to an outer periphery of a layer, a shoulder at an outlet of the perforation for guiding the plurality of sub-projectiles into the shell body element, and a holding ring fastened on the assembly centering device extending coaxially with the shoulder.

In accordance with an additional feature of the present invention, the top portion forms a first stop for the plurality of sub-projectiles in the reservoir, and a lower part of the perforation forms a second stop for the plurality of sub-projectiles.

In accordance with another feature of the present invention, the top portion and a lower part of the perforation are shaped such that the arrangement of the plurality of sub-projectiles positioned at the first stop and arrangement of the plurality of sub-projectiles positioned at the second stop are substantially similar.

In accordance with yet another feature of the present invention, the V-shaped notch of the top portion includes a pair of inclined faces and the V-shape of the bottom portion includes a pair of inclined faces, each the pair of inclined faces forming an angle of 120° therebetween and corresponding to a pair of sides of a hexagon shape.

In accordance with still another feature of the present invention the V-shaped notch of the top portion including a pair of inclined faces and the V-shape of the bottom portion including a pair of inclined faces, each the pair of inclined faces forming an angle of 120° therebetween and corresponding to a pair of sides of an asymmetrical hexagon shape.

In accordance with another feature of the present invention, the slider further includes a distance between a vertex of the V-shaped notch of the top portion and vertex of the V-shape of the bottom portion approximately corresponding to a diameter of a circle circumscribing the hexagon shape.

In accordance with another feature of the present invention, the slider further includes a distance between a vertex of the V-shaped notch of the top portion and vertex of the V-shape of the bottom portion approximately corresponding to a diameter of a circle circumscribing the asymmetrical hexagon shape.

In accordance with yet another feature of the present invention, the apparatus further includes at least one recess provided on each side of the assembly centering device, each the at least one recess coupled to an opening in the perforation, the at least one recess including a slide face downwardly sloping at a defined angle, the slide face including an upper portion coupled approximately to a respective upper corner point of a vertical side of the hexagon shape formed by the perforation.

In accordance with still another feature of the present invention, the width of the reservoir corresponding to a length of the cylindrical sub-projectiles, and a length of the reservoir corresponding to a distance between parallel sides of the hexagon shape.

In accordance with a further feature of the present invention, the apparatus further includes a plurality of additional U-shaped assembly centering devices provided between the assembly centering device and the cover, a plurality of additional reservoirs formed in accordance with the plurality of additional assembly centering devices, and a plurality of additional perforations, provided in each of the plurality of additional assembly centering devices, each plurality of additional perforations including an additional first part having a same shape in cross-section as the first part of the perforation and extending concentrically with respect to the perforation.

In accordance with yet another feature of the present invention, the apparatus further includes a plurality of additional recesses provided on the sides of the plurality of additional assembly centering devices which are coupled with the plurality of additional perforations via a plurality of additional openings, and the plurality of additional recesses include a plurality of additional slide faces which are downwardly sloping by a defined angle, each of the plurality of additional slide faces including an upper portion coupled approximately to a respective upper corner point of a vertical side of the hexagon shape formed by the additional perforation.

In accordance with another feature of the present invention, the apparatus further includes a plurality of ejection lugs disposed in a plurality of additional second parts of the plurality of additional perforations which project into grooves of an additional slider which can be pushed through each of the plurality of additional recesses.

The advantages achieved by the present invention may be found in a considerable reduction in filling time and costs. Further, errors created by shifting sub-projectiles may be largely prevented to reduce waste to a minimum. An optimal, even distribution of sub-projectiles on circular paths may also be achieved following ejection and, thus, may improve the probability of hitting a target.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
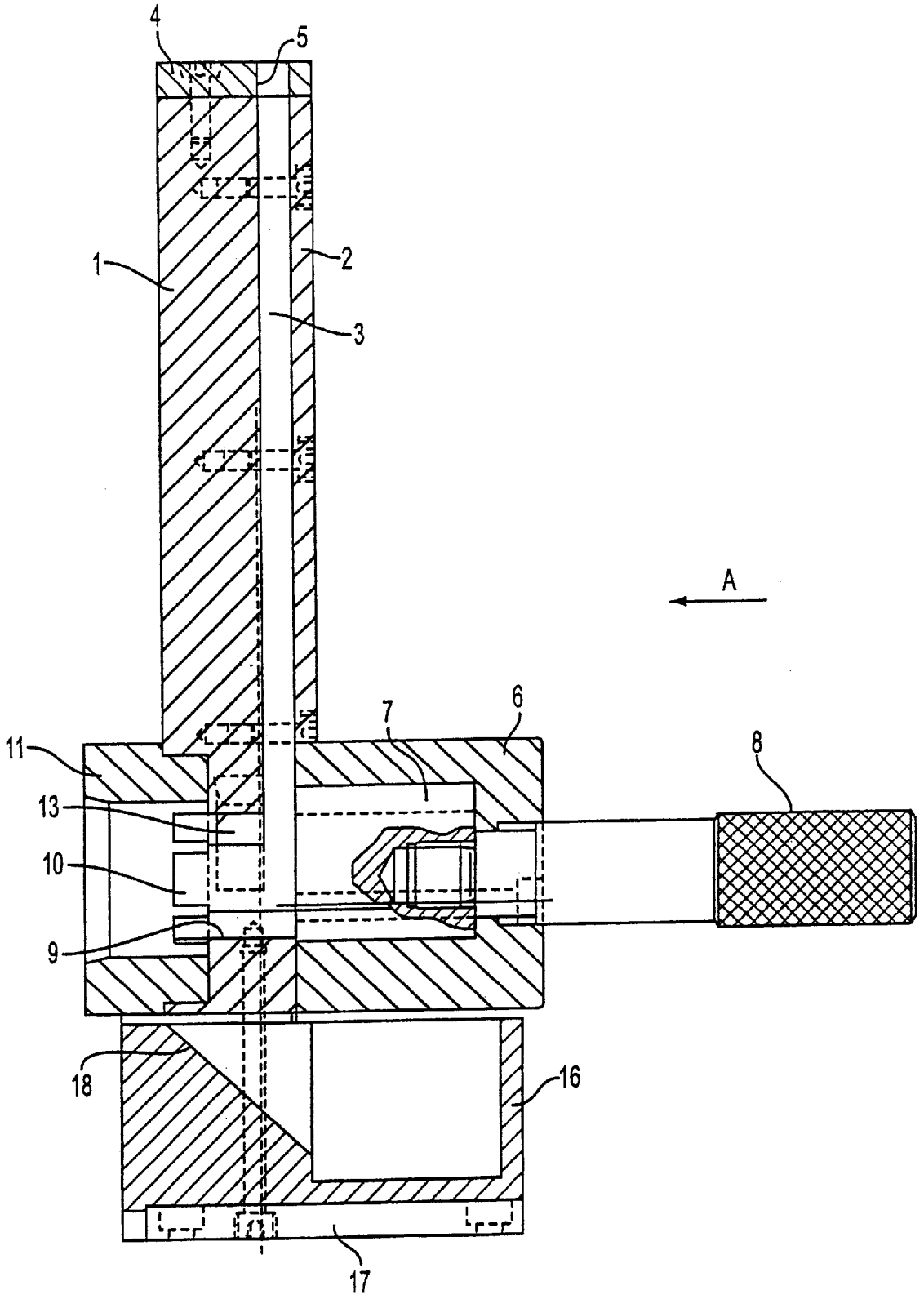
FIG. 1 is a longitudinal section of the device in accordance with the invention along the line I—I in FIG. 2.
Figure 2:
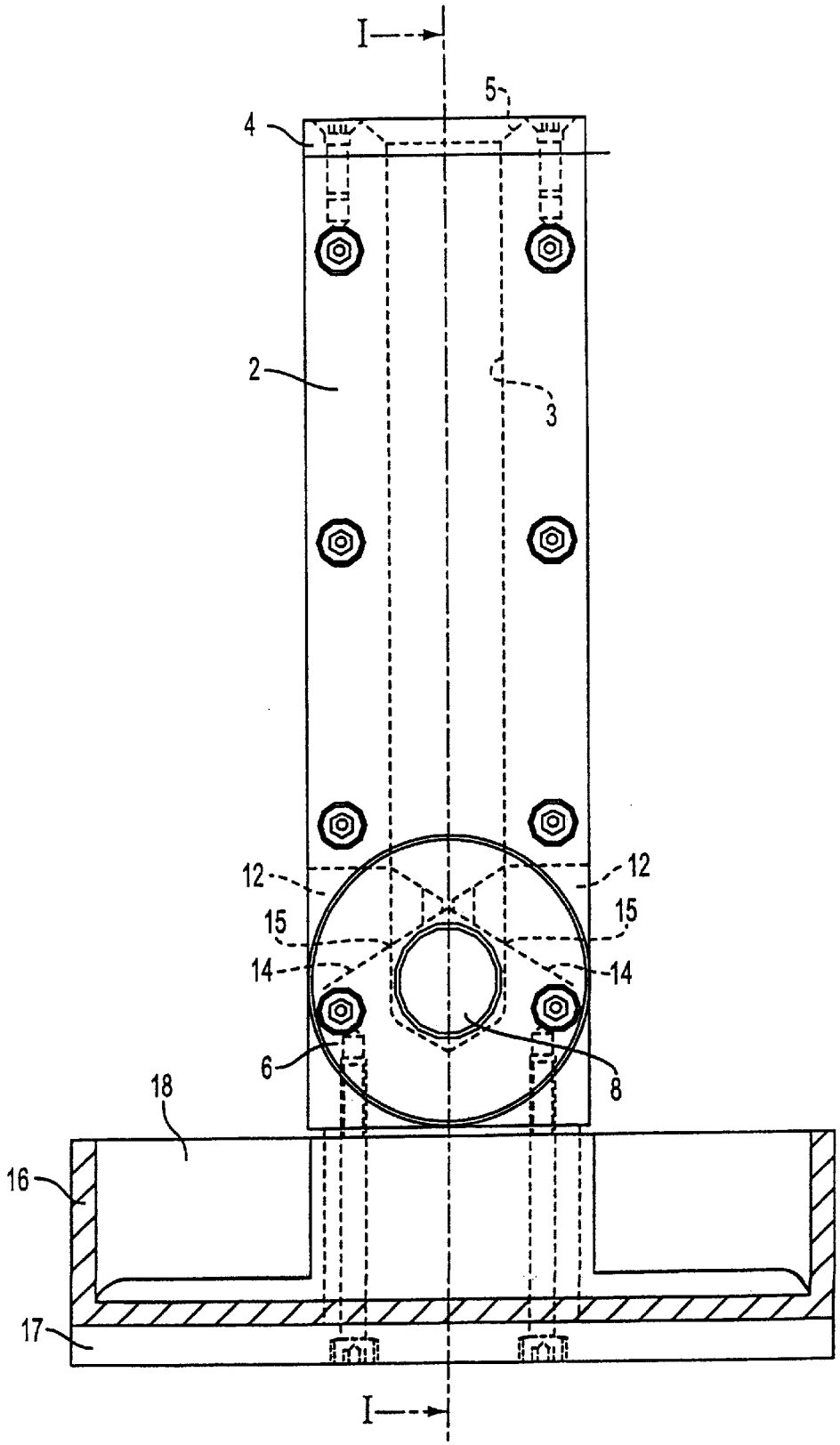
FIG. 2 is a partially cut view of the device in the direction of the arrow A in FIG. 1.

A cross-sectionally U-shaped assembly centering device 1, may be coupled, e.g., by screw connection, with a cover 2, as shown in FIGS. 1 and 2. Assembly centering device 1 and cover 2 form a reservoir 3, which forms a rectangular slit in cross-section with a width (FIG. 1) corresponding to the length of cylindrical sub-projectiles 20 (FIGS. 3, 4) to be inserted within reservoir 3. The length of reservoir 3 (FIG. 2) may be determined by the diameter and number of individual sub-projectiles 20, as well as the geometric arrangement thereof (FIGS. 3, 4). A cover plate 4, fastened to assembly centering device 1, has a slit 5 which may be approximately congruent to the cross-section of reservoir 3. A slider 7 may be connected with a handle 8 for ease of manipulation and may be horizontally guided in a flange 6. Flange 6 may be screwed together with assembly centering device 1 in the lower area of reservoir 3. In cross-section the width of the slider 7 corresponds to the length of the rectangular cross-section of reservoir 3. Slider 7 may include a V-shaped notch extending along a longitudinal direction. Inclined faces of the V-shaped notch (7.1, FIG. 5*c*) enclose an angle of, e.g., 120° in a preferred embodiment and which may correspond to the sides of a regular hexagon.

The underside of slider 7 may be shaped in a V-shape parallel to the V-shaped notch such that the inclined faces of the underside of slider 7 (7.2, FIG. 5*c*) enclose an angle of, e.g., 120°. Like the inclined surfaces of the V-shaped notch, the inclined surfaces of the underside of slider 7 may correspond to the sides of a regular hexagon. Assembly centering device 1 has a perforation 9, which may extend coaxially with slider 7 and may be connected on an inlet side with reservoir 3. Perforation 9 may also include an outline in a first part of assembly centering device 1 approximately corresponding with the previously described outline of slider 7. A shoulder 10 for guiding the sub-projectiles to be inserted into a shell body element 41 (FIG. 14) is provided at the outlet of the perforation 9. During the filling process of the shell body, shell body element 41 may be centered in a holding ring 11 extending coaxially with shoulder 10 and fastened on assembly centering device 1.

Recesses 12 may be provided on the sides of assembly centering device 1 which are connected with perforation 9 via openings 13. The recesses 12 may include slide faces 14 which are downwardly inclined at an angle of, for example, 30° in respect to the horizontal and which may have their beginning approximately at upper corner points 15 of the vertical sides of the regular hexagon formed by perforation 9.

Assembly centering device 1 may be bolted together with a catch receptacle 16 and a base plate 17. Catch receptacle 16 may include two inclined feed faces 18 for surplus sub-projectiles disposed on both sides of assembly centering 1 in the area of openings 13.

Figure 3A:
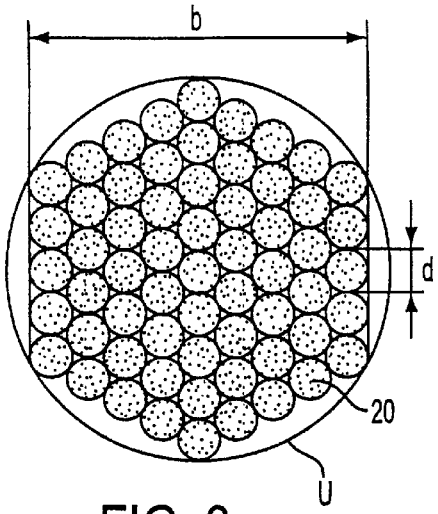
FIGS. 3*a,* 3*b,* 3*c* show geometric arrangements of sub-projectiles in planes extending transversely with respect to a longitudinal axis of a shell body.
Figure 3B:
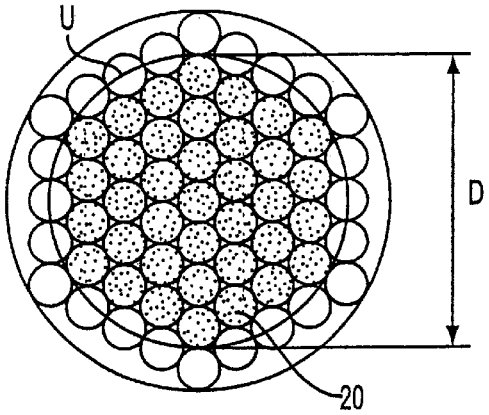
Figure 3C:
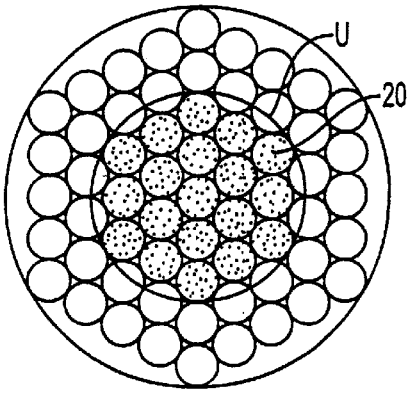

In accordance with FIGS. 3*a* to 3*c,* individual cylindrical sub-projectiles 20, with a diameter d, may be combined into layers 40 (FIG. 14) in the shape of, e.g., regular hexagons, which may be associated with shell bodies of different diameters. Layers 40 may be disposed in planes extending transversely to the longitudinal axis 43 (FIG. 14) of shell body element 41, wherein the axes of individual sub-projectiles 20 may be aligned parallel with longitudinal axis 43. Regular hexagons may be circumscribed by a circle U, whose diameter D may be equal to a whole number multiple of individual sub-projectile diameter d. The circle U may correspond to the interior cross-sectional area of the shell body. A distance b between two parallel extending sides of the regular hexagon may be equal to diameter d and the number of individual sub-projectiles 20, and the geometric arrangement thereof, as mentioned above.

Figure 4A:
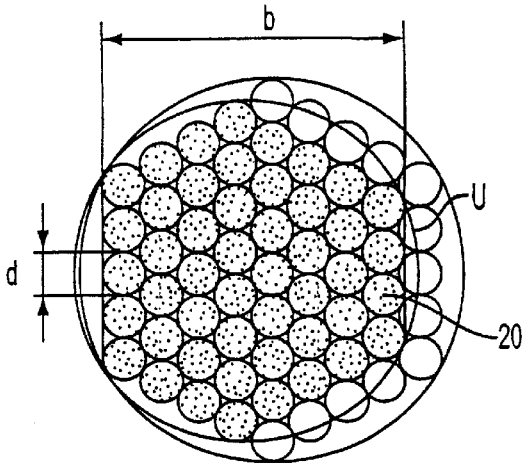
FIGS. 4*a,* 4*b,* 4*c* show further embodiments of geometric arrangements of sub-projectiles in planes extending transversely with respect to the longitudinal axis of a shell body.
Figure 4B:
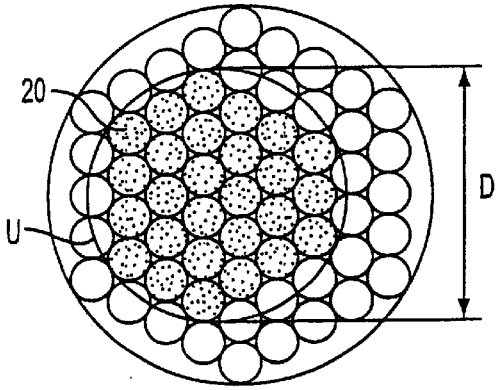
Figure 4C:
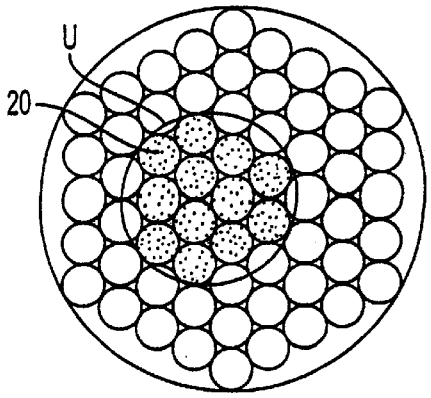
Figure 5A:
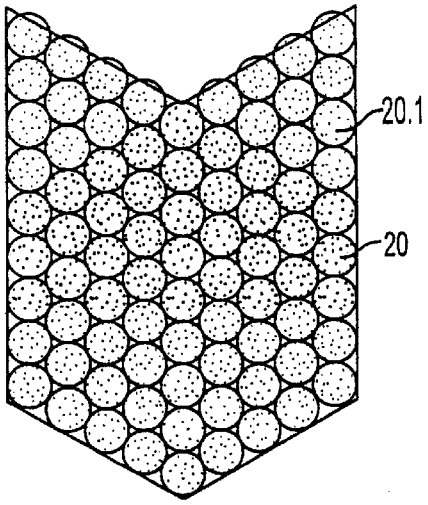
FIGS. 5*a,* 5*b,* 5*c* show cross-sectional forms of a slider of the device for employment with arrangements in accordance with FIGS. 3*a* to 3*c;*
Figure 6A:
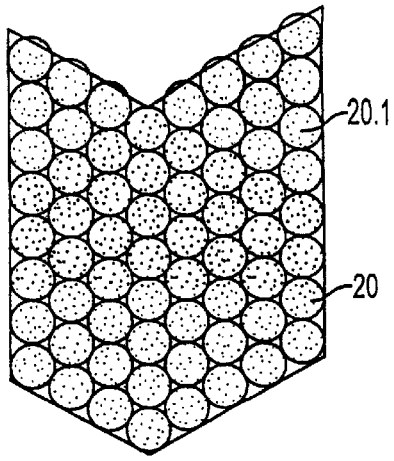
FIGS. 6*a,* 6*b,* 6*c* show cross-sectional forms of a slider of the device for employment with arrangements in accordance with FIGS. 4*a* to 4*c;*
Figure 5B:
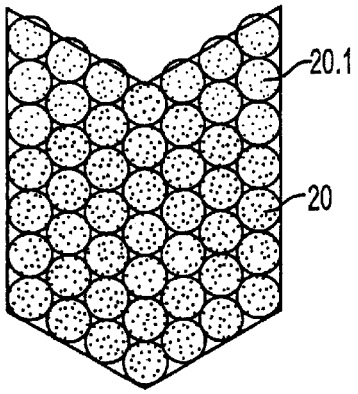
Figure 6B:
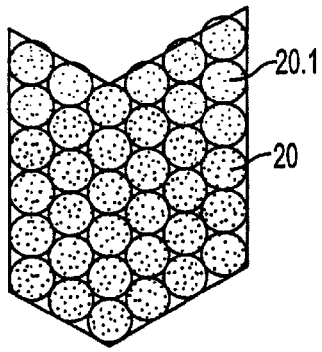
Figure 5C:
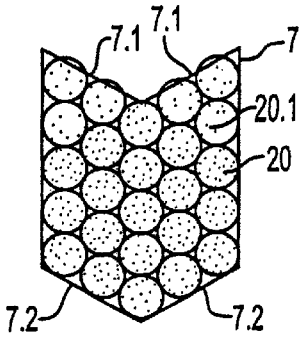
Figure 6C:
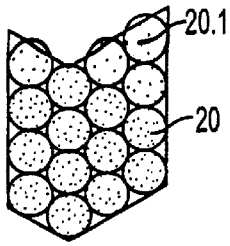
Figure 8:
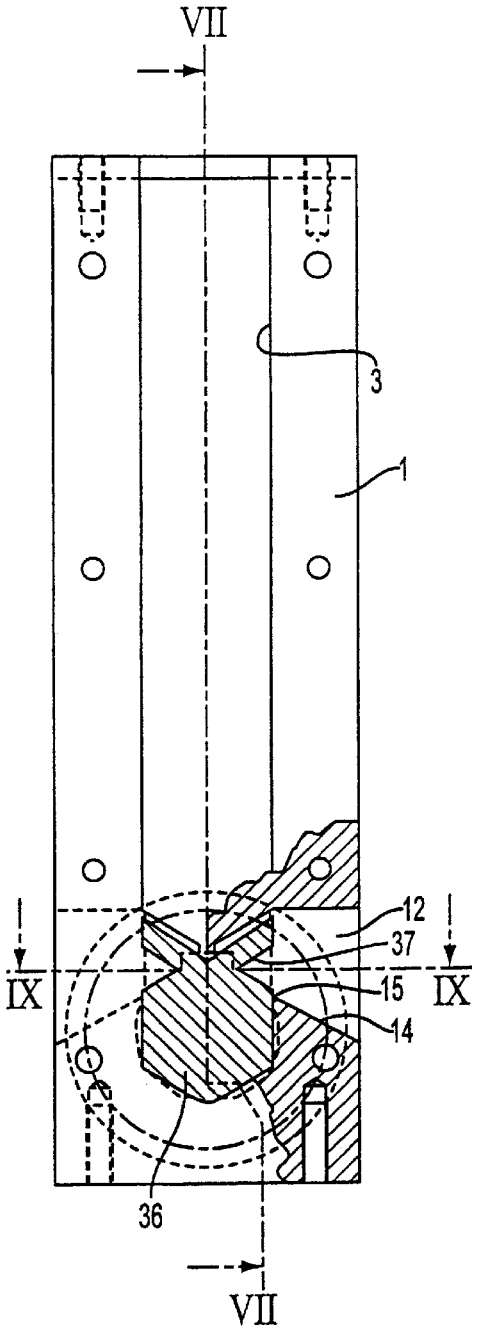
FIG. 8 shows a partially cut view of the first reservoir in the direction of the arrow B in FIG. 7.
Figure 7:
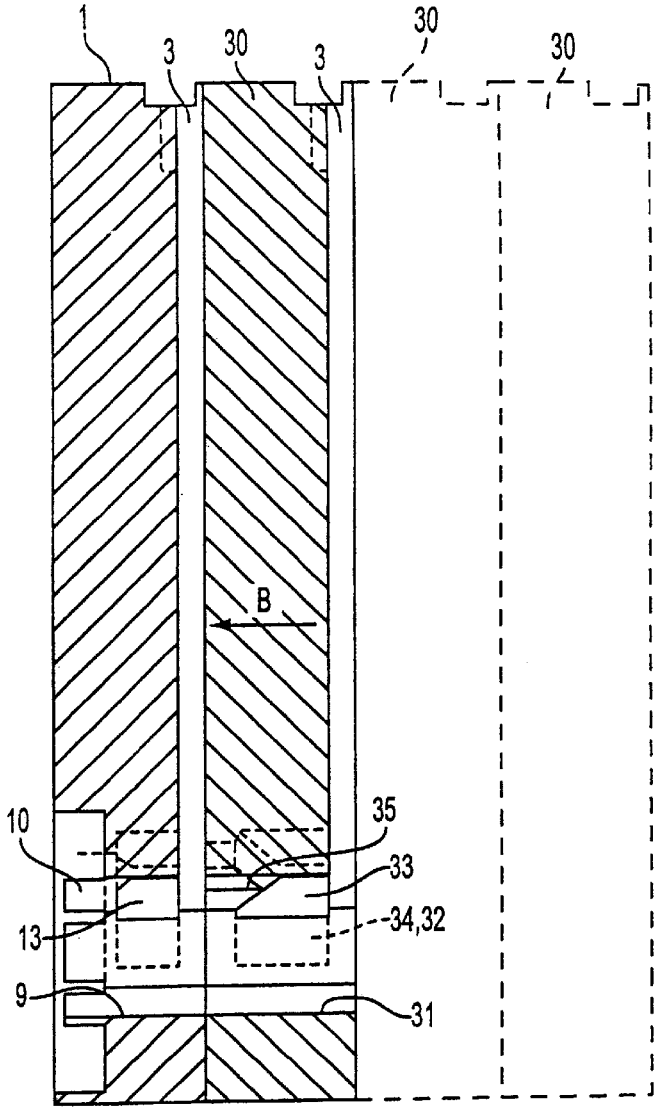
FIG. 7 is a longitudinal section through reservoirs of a second embodiment of the device along the line VII—VII in FIG. 8.
Figure 9:
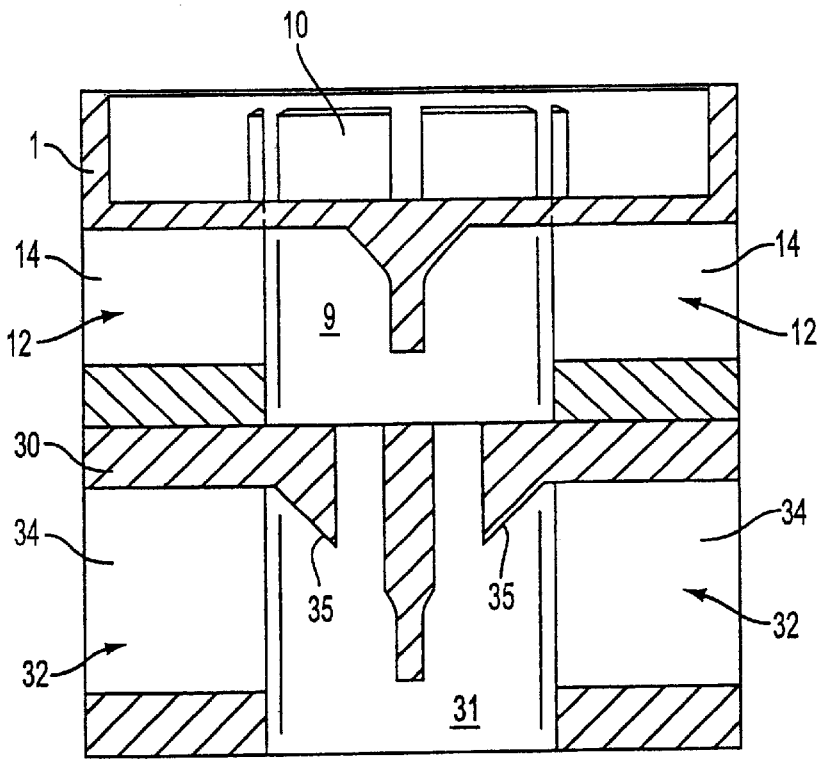
FIG. 9 shows a cross section through two reservoirs of the second embodiment along the line IX—IX in FIG. 8.
Figure 10:
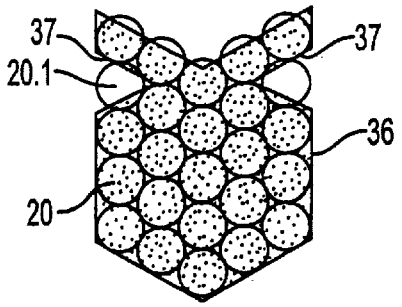
FIG. 10 is a cross section through a slider of the second embodiment of the device.

As shown in FIGS. 4*a* to 4*c,* individual cylindrical sub-projectiles 20 of diameter d may be combined into layers 40 in the shape of, e.g., irregular (asymmetrical) hexagons which may be associated with shell bodies of various diameters. In the process, it may be necessary to determine the distance b as well as the diameter D from the number and diameters d of individual sub-projectiles 20 and the geometric arrangement thereof.

In accordance with FIGS. 5*a* to 5*c* and 6*a* to 6*c,* the surplus sub-projectiles which are discarded during filling may be identified by 20.1.

Further U-shaped assembly centering devices may be identified by 30 in FIGS. 7 to 10 and may be connected together, e.g., bolted, with assembly centering device 1. A number of reservoirs 3 may be formed equal to the number of assembly centering devices 1, 30 connected together. Perforations 31 may be provided in the further assembly centering devices 30 which, in a first part of the assembly centering devices 30, may have the same cross-sectional shape as perforation 9 of assembly centering device 1 (FIG.

1) and extend concentrically with respect to it. Recesses 32 may be provided on the sides of the further assembly centering devices 30 which are in contact with the perforation 31 via openings 33. Recesses 32 may have slide faces 34 which are downwardly inclined at an angle of, for example, 30° with respect to the horizontal and which have their beginning approximately at upper corner points of the vertical sides of a regular hexagon formed by perforation 31. Ejection lugs 35 may be disposed in perforation 31, which may extend into grooves 37 of a further slider 36, which can be moved through the perforations 9, 31. The cross-section of further slider 36 corresponds with the cross-section of slider 7 of FIG. 1, except for inclusion of grooves 37. The length of further slider 36 also extends over all assembly centering devices 1, 30. Although not shown in more detail, the above described device is connected with a catch receptacle and a base plate, similar to the device in FIGS. 1 and 2, as well as with a holding ring 11 for the shell body element 41, a flange for the guidance of slider 36 and a cover 2.

Figure 11B:
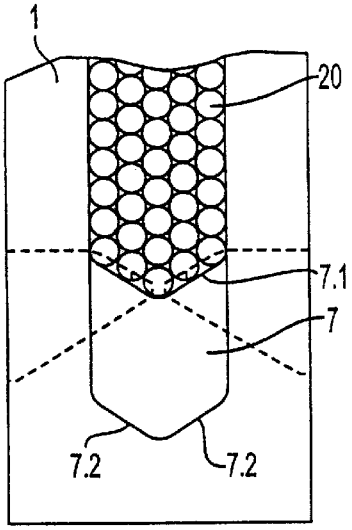
FIGS. 11*a,* 11*b* show the device in accordance with FIGS. 1 and 2 during a first method step.
Figure 11A:
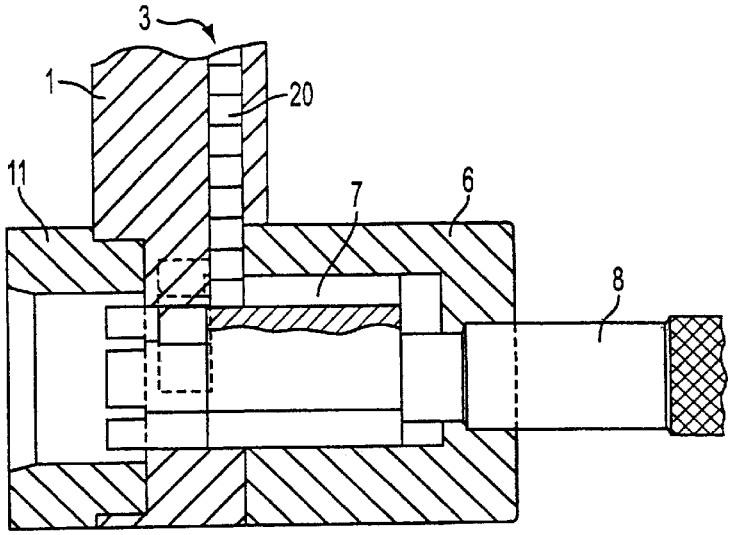

The device shown in FIGS. 1 and 2 may operate such that in a first step, sub-projectiles 20 may be fed (FIGS. 11*a*, 11*b*) to reservoir 3 by a vibrating helical conveyor (not shown), where they may fall perpendicularly downward onto a first stop, formed by the V-shaped notch of slider 7. In operation, the desired geometric arrangement may be formed corresponding to the shape of slider 7 and the cross-sectional length of reservoir 3. Further, the outer periphery of layer 40, comprising individual sub-projectiles 20, may be partially formed, in accordance with a preferred embodiment, for example, in the shape of a regular hexagon.

Figure 12B:
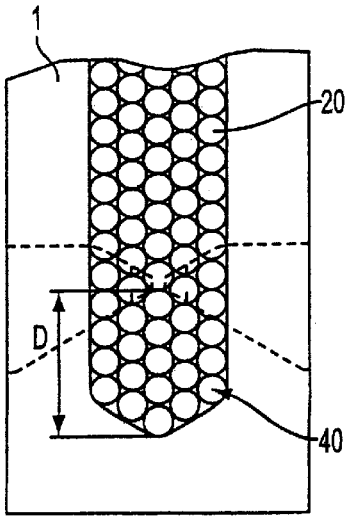
FIGS. 12*a,* 12*b* show the device in accordance with FIGS. 1 and 2 during a second method step.
Figure 12A:
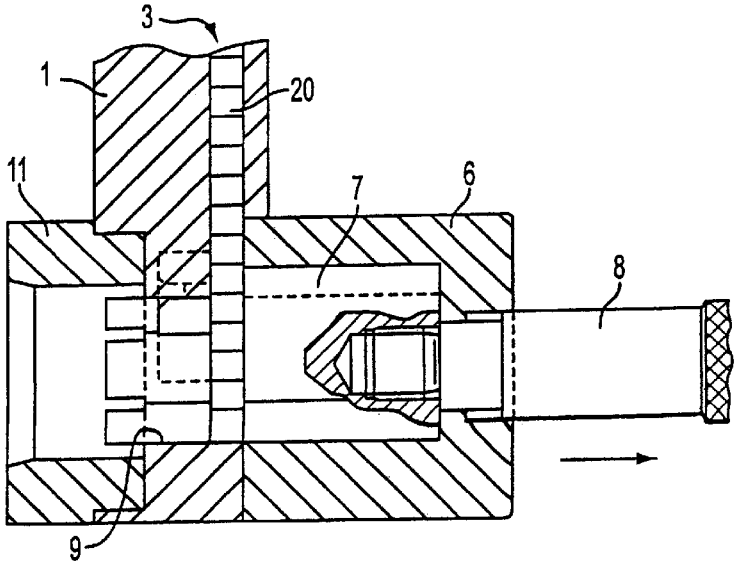

In a second step, the slider 7 may be retracted (FIGS. 12*a*, 12*b*), so that individual sub-projectiles 20 fall onto a second, lower stop defined by an amount corresponding to diameter D of circumscribed circle U of the regular hexagon shape. Since the second stop is formed by the shape of the lower part of the perforation 9 (or reservoir 3), the geometric arrangement and the partially formed outer periphery of layer 40 may be maintained in the process.

Figure 13A:
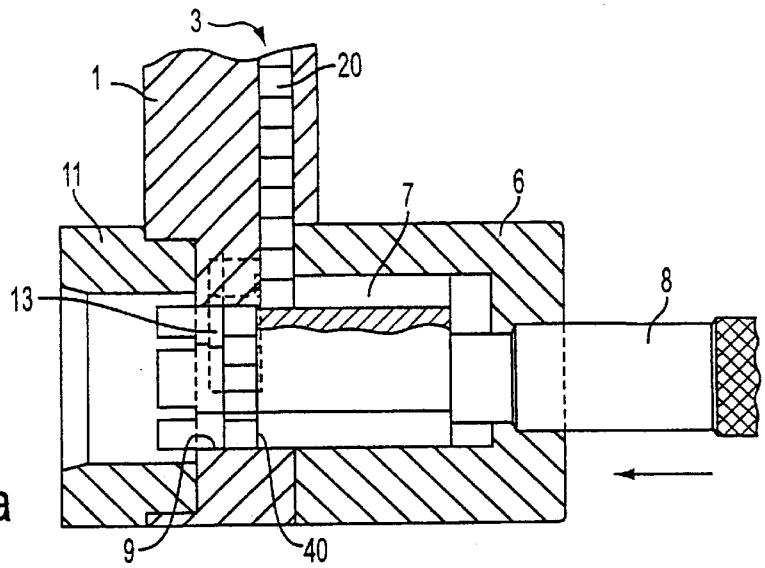
FIGS. 13*a,* 13*b* show the device in accordance with FIGS. 1 and 2 during a third method step.
Figure 13B:
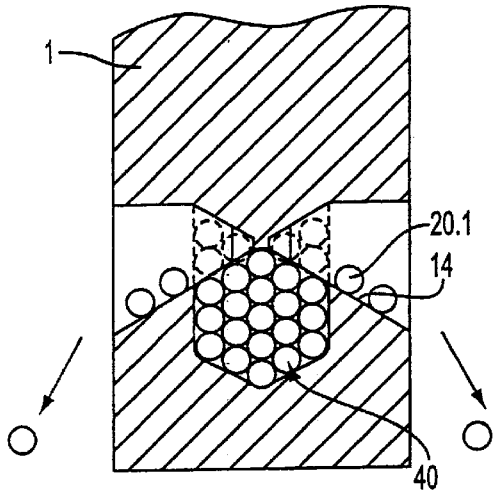

In a third step, individual sub-projectiles 20 located between the first and second stop may be pushed by slider 7 in a fill direction from reservoir 3 into perforation 9 (FIGS. 13*a*, 13*b*). The final shaping of the outer periphery of layer 40 occurs when surplus sub-projectiles 20.1 (FIG. 5*c*) are removed through opening 13 and roll down slide faces 14. In operation, surplus sub-projectiles 20.1 may fall on feed faces 18 and be transported to catch receptacle 16. Surplus sub-projectiles 20.1 may be taken out of catch receptacle 16 and may be re-supplied to the vibrating helical conveyor for further processing.

Concurrently with the final shaping of the outer periphery of layer 40, pre-shaped layer of sub-projectiles is held on the upper V-shaped notch surface 7.1 of the slider 7.

Figure 14:
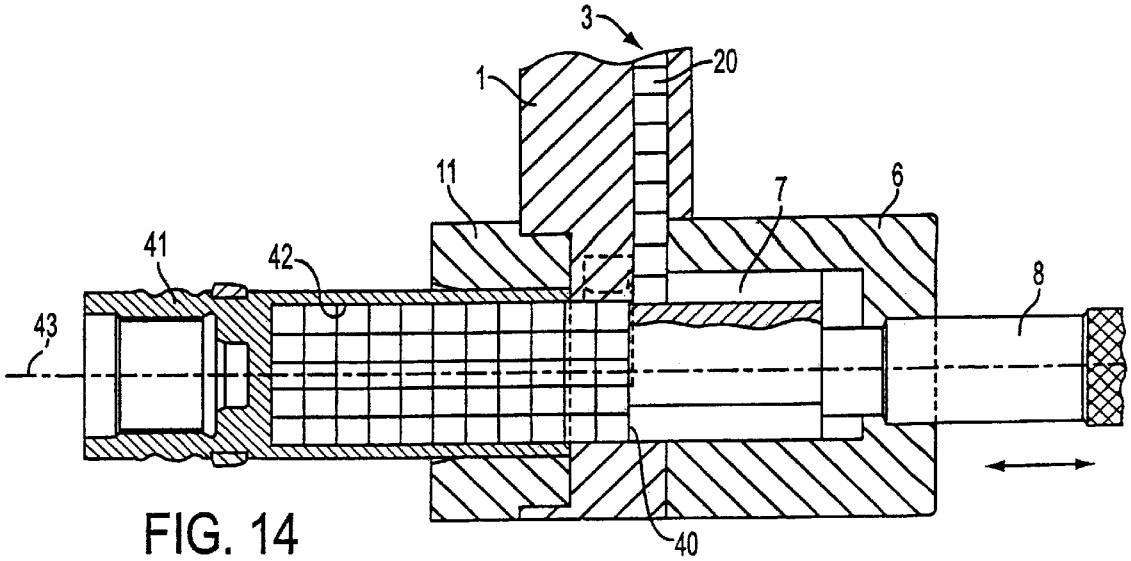
FIG. 14 shows the device in accordance with FIGS. 1 and 2 during a fourth method step.

In a fourth step, the finished formed layers may be introduced into a hollow chamber 40 of shell body element 41 (FIG. 14). During a repeated back and forth movement of slider 7, successive layers 40 may be displaced by a respective following layer 40 until the hollow chamber is filled. In operation, it is possible in accordance with the exemplary embodiment and using the layer 40 arrangement in accordance with FIG. 3*c*, to place eight successive layers 40 of nineteen individual sub-projectiles 20 each into shell body element 41.

During the first and second steps, the second embodiment of the present invention, shown in FIGS. 7 to 10, may operate substantially similar to the above-described assembly centering device 1. Further, when the assembly centering device 1 is coupled with second assembly centering devices 30, the return movement of further slider 36 may extend over the entire assembly of assembly centering devices 1, 30. In the third step of the second embodiment, the final shaping of the outer periphery of layer 40 in assembly centering device 1 occurs as described above.

In the further assembly centering device 30, the lowermost excess sub-projectiles 20.1 push against ejection lugs 35 during a stroke movement of slider 36. This movement causes surplus sub-projectiles 20.1 to be removed through openings 33 to roll down over slide faces 34. The fourth step is the same as described above, however, the number of stroke movements may be reduced in accordance with the number of reservoirs 3 formed. It may also be possible to achieve an optimal result if the number of reservoirs 3 is the same as the number of the required layers. As such, only a single stroke of slider 36 would be necessary to fill a shell body.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for filling a shell body with a plurality of sub-projectiles comprising:

a U-shaped assembly centering device coupled with a cover;

a reservoir, formed between said assembly centering device and said cover, comprising a slit-like shaped rectangle in cross-section;

a flange fastened in a lower area of said reservoir on said assembly centering device;

a slider for moving with respect to said reservoir comprising a width corresponding to a length of said slit-like rectangle, a top portion including a V-shaped notch extending along a longitudinal direction, and a bottom portion including a V-shape extending along the longitudinal direction;

a perforation, extending coaxially with said slider and provided in said assembly centering device, comprising a first part approximately corresponding to an outline of said slider and a second part approximately corresponding to an outer periphery of a layer;

a shoulder at an outlet of said perforation for guiding said plurality of sub-projectiles into said shell body element; and a holding ring fastened on said assembly centering device extending coaxially with said shoulder.

2. The device in accordance with claim 1, said top portion forming a first stop for said plurality of sub-projectiles in said reservoir, and a lower part of said perforation forming a second stop for said plurality of sub-projectiles.

3. The device in accordance with claim 1, said top portion and a lower part of said perforation are shaped such that the arrangement of said plurality of sub-projectiles positioned at said first stop and arrangement of said plurality of sub-projectiles positioned at said second stop are substantially similar.

4. The device in accordance with claim 1, said V-shaped notch of said top portion comprising a pair of inclined faces and said V-shape of said bottom portion comprising a pair of inclined faces, each said pair of inclined faces forming an angle of 120° therebetween and corresponding to a pair of sides of a hexagon shape.

5. The device in accordance with claim 1, said V-shaped notch of said top portion comprising a pair of inclined faces and said V-shape of said bottom portion comprising a pair of inclined faces, each said pair of inclined faces forming an angle of 120° therebetween and corresponding to a pair of sides of an asymmetrical hexagon shape.

6. The device in accordance with claim 4, said slider further comprising a distance between a vertex of said V-shaped notch of said top portion and vertex of said V-shape of said bottom portion approximately corresponding to a diameter of a circle circumscribing said hexagon shape.

7. The device in accordance with claim 4, further comprising at least one recess provided on each side of said assembly centering device, each said at least one recess coupled to an opening in said perforation, said at least one recess comprising a slide face downwardly sloping at a defined angle, said slide face comprising an upper portion coupled approximately to a respective upper corner point of a vertical side of said hexagon shape formed by said perforation.

8. The device in accordance with claim 7, the width of said reservoir corresponding to a length of said cylindrical sub-projectiles, and a length of said reservoir corresponding to a distance between parallel sides of said hexagon shape.

9. The device in accordance with claim 1, further comprising:

a plurality of additional U-shaped assembly centering devices provided between said assembly centering device and said cover;

a plurality of additional reservoirs formed in accordance with said plurality of additional assembly centering devices; and a plurality of additional perforations, provided in each of said plurality of additional assembly centering devices, each plurality of additional perforations including an additional first part having a same shape in cross-section as said first part of said perforation and extending concentrically with respect to said perforation.

10. The device in accordance with claim 9, further comprising:

a plurality of additional recesses provided on the sides of said plurality of additional assembly centering devices which are coupled with said plurality of additional perforations via a plurality of additional openings, and said plurality of additional recesses include a plurality of additional slide faces which are downwardly sloping by a defined angle, each of said plurality of additional slide faces including an upper portion coupled approximately to a respective upper corner point of a vertical side of said hexagon shape formed by said additional perforation.

11. The device in accordance with claim 10, further comprising:

a plurality of ejection lugs disposed in a plurality of additional second parts of said plurality of additional perforations which project into grooves of an additional slider which can be pushed through each of the plurality of additional recesses.

12. The device in accordance with claim 4, said slider further comprising a distance between a vertex of said V-shaped notch of said top portion and vertex of said V-shape of said bottom portion approximately corresponding to a diameter of a circle circumscribing said asymmetrical hexagon shape.

* * * * *